US009452764B2

(12) United States Patent
Stern et al.

(10) Patent No.: US 9,452,764 B2
(45) Date of Patent: Sep. 27, 2016

(54) RAILWAY VEHICLE COUPLER

(71) Applicant: Pennsy Corporation, West Chester, PA (US)

(72) Inventors: Aaron Stern, West Chester, PA (US); Perry Levitt, West Chester, PA (US); Manuel Tavares, Doylestown, PA (US); Zachary Ryan Brook, Leola, PA (US); Wayne H. Murphy, Pottstown, PA (US)

(73) Assignee: PENNSY CORPORATION, West Chester, PA (US)

( * ) Notice: Subject to any disclaimer, the term of this patent is extended or adjusted under 35 U.S.C. 154(b) by 0 days.

(21) Appl. No.: 14/273,285

(22) Filed: May 8, 2014

(65) Prior Publication Data

US 2014/0360963 A1 Dec. 11, 2014

Related U.S. Application Data

(63) Continuation-in-part of application No. 14/171,700, filed on Feb. 3, 2014, and a continuation-in-part of application No. 13/678,203, filed on Nov. 15, 2012, now Pat. No. 9,038,836.

(51) Int. Cl.

| | |
|---|---|
| ***B61G 3/00*** | (2006.01) |
| ***B61G 3/04*** | (2006.01) |
| ***B22C 7/02*** | (2006.01) |

(Continued)

(52) U.S. Cl.

CPC . *B61G 3/04* (2013.01); *B22C 7/02* (2013.01); *B22C 9/046* (2013.01); *B22C 9/22* (2013.01); *B22D 23/02* (2013.01); *B22D 25/02* (2013.01)

(58) Field of Classification Search

CPC ..... B61G 1/00; B61G 1/02; B61G 1/10; B61G 1/28; B61G 3/00; B61G 3/02; B61G 3/04; B61G 3/28; B61G 3/30

USPC ..... 213/75 R, 77, 85, 86, 88, 100 R, 175, 213/176

See application file for complete search history.

(56) References Cited

U.S. PATENT DOCUMENTS

| | | | |
|---|---|---|---|
| 461,312 | A | 10/1891 | Brown |
| 533,985 | A | 2/1895 | Brown |

(Continued)

OTHER PUBLICATIONS

Brandenberg, Kristin; "Successfully Machining Austempered Ductile Iron (ADI)"; Applied Process Inc. Technologies Div.—Livonia, Michigan, USA; Oct. 2001.

(Continued)

*Primary Examiner* — Robert McCarry, Jr.

(74) *Attorney, Agent, or Firm* — John F. A. Earley, III; Frank J. Bonini, Jr.; Harding, Earley, Follmer & Frailey, P.C.

(57) ABSTRACT

A railcar coupler having a head portion extending from a shank portion, the coupler head portion is configured to couple to a first coupler knuckle for coupling the railcar coupler to a second railcar coupler of an adjacent railcar. The coupler has weight reduction features that also are configured to provide strength to the coupler when handling forceloads. The coupler may have a head with a front face with bores provided in the front face a cavity extending through the coupler, a guard arm with cavities formed therein, and a shank having a plurality of longitudinal cavities and adjacent ribs separating the cavities. Preferred embodiments may be constructed from an austempered metal.

17 Claims, 6 Drawing Sheets

(51) Int. Cl.

| | |
|---|---|
| ***B22C 9/04*** | (2006.01) |
| ***B22C 9/22*** | (2006.01) |
| ***B22D 23/02*** | (2006.01) |
| ***B22D 25/02*** | (2006.01) |

(56) References Cited

U.S. PATENT DOCUMENTS

| | | | | |
|---|---|---|---|---|
| 693,998 | A | 2/1902 | Brown | |
| 2,088,135 | A * | 7/1937 | Johnson | B61G 3/04 213/155 |
| 2,562,504 | A | 7/1951 | Metzger | |
| 2,689,051 | A | 9/1954 | Kayler | |
| 3,604,569 | A | 9/1971 | Kulieke | |
| 3,670,901 | A | 6/1972 | Metzger | |
| 3,722,708 | A | 3/1973 | Ion et al. | |
| 3,779,397 | A | 12/1973 | De Penti | |
| 3,854,599 | A | 12/1974 | Day et al. | |
| 3,856,156 | A | 12/1974 | Metzger | |
| 4,081,082 | A * | 3/1978 | Scherrer | B61G 7/00 213/62 A |
| 4,090,615 | A | 5/1978 | Martin | |
| 4,206,849 | A * | 6/1980 | Kaim | B61G 3/06 213/109 |
| 4,537,304 | A | 8/1985 | Kaim et al. | |
| 4,591,059 | A | 5/1986 | Hammarlund | |
| 4,605,133 | A * | 8/1986 | Altherr | B61G 3/00 213/109 |
| 4,645,085 | A | 2/1987 | Hanula et al. | |
| 5,096,076 | A | 3/1992 | Elliott et al. | |
| 5,320,229 | A | 6/1994 | Mautino et al. | |
| 5,511,676 | A | 4/1996 | Holmes | |
| 5,582,307 | A * | 12/1996 | Hawthorne | B22C 9/02 213/109 |
| 5,878,897 | A * | 3/1999 | Lazzaro | B61G 3/06 213/139 |
| 5,900,082 | A | 5/1999 | Hewitt | |
| 5,954,212 | A | 9/1999 | Beatty et al. | |
| 6,129,227 | A | 10/2000 | Openchowski et al. | |
| 6,155,442 | A | 12/2000 | Wurzer et al. | |
| 6,796,448 | B1 | 9/2004 | Wilt et al. | |
| 7,302,994 | B2 | 12/2007 | Mautino et al. | |
| 7,337,826 | B2 | 3/2008 | Mautino et al. | |
| 7,757,871 | B2 | 7/2010 | Mautino et al. | |
| 8,056,741 | B2 | 11/2011 | Mautino et al. | |
| 8,196,762 | B2 | 6/2012 | Smerecky | |
| 8,201,613 | B2 | 6/2012 | Marchese et al. | |
| 8,297,455 | B2 | 10/2012 | Smyth | |
| 8,381,923 | B2 | 2/2013 | Smyth | |
| 8,408,406 | B2 | 4/2013 | Smerecky et al. | |
| 8,485,371 | B2 | 7/2013 | Nibouar et al. | |
| 8,544,662 | B2 | 10/2013 | Smerecky et al. | |
| 8,662,327 | B2 * | 3/2014 | Nibouar | B22C 9/10 164/137 |
| 2004/0173555 | A1 | 9/2004 | Wilt et al. | |
| 2008/0128377 | A1 | 6/2008 | Mautino et al. | |
| 2009/0289024 | A1 | 11/2009 | Nibouar et al. | |
| 2010/0326943 | A1 | 12/2010 | Mautino et al. | |
| 2011/0024379 | A1 | 2/2011 | Ely | |
| 2011/0068077 | A1 | 3/2011 | Smyth | |
| 2011/0163059 | A1 | 7/2011 | Gagliardino et al. | |
| 2011/0168655 | A1 | 7/2011 | Nibouar et al. | |
| 2012/0292279 | A1 | 11/2012 | Wilt et al. | |
| 2013/0042785 | A1 | 2/2013 | Schmidt et al. | |
| 2014/0076193 | A1 | 3/2014 | Brook et al. | |

OTHER PUBLICATIONS

A. Kahn and B.K. Chen, "Evaluation of Grade 1 Austempered Ductile Iron for Application to Rail Cast Components", Proceedings of the Fifth Asia Pacific Industrial Engineering and Management Systems Conference 2004.

Luís Magalhães, Jorge Seabra, "Teeth Surface Failures in Austempered Ductile Iron (ADI) Gears", Gears and Transmission Workshop, Paper No. XIII, pp. 269-286, Faculdade de Engen-haria da Universidade do Porto, Portugal, Jun. 5, 2003.

Stokes, B. et al.; "Effects of Carbides on Fatigue Characteristics of Austempered Ductile Iron", Metallurgical and Materials Transactions A, 36 (2005) 977-988.

Bubenko et al.; "Fatigue Crack Propagation through Austempered Ductile Iron Microstructure"; Materials Engineering, vol. 17, 2010, No. 3, pp. 15-20.

Bubenko et al.; "Fatigue Crack Propagation Within the Austempered Ductile Iron Microstructure"; Acta Metallurgica Slovaca, vol. 17, 2011, No. 1, pp. 18-25.

Dundar, Sacit; "Application of Austempered Ductile Iron to Rail Wheel Sets"; Journal of Engineering Sciences 2003, 9 (3), pp. 283-287.

International ADI and Simulation Conference; May 28-30, 1997.

Knuckles, Types E and F—Fatigue Test, AAR Manual of Standards and Recommended Practices Castings, 2009, [M-216] 1-2.

* cited by examiner

RAILWAY VEHICLE COUPLER

CROSS-REFERENCE TO RELATED APPLICATIONS

The benefits under 35 U.S.C. §§119(e), 120, 121 of the following are hereby claimed: U.S. application Ser. No. 14/171,700, filed on Feb. 3, 2014, and U.S. application Ser. No. 13/678,203, filed on Nov. 15, 2012, the complete contents of which are incorporated herein by reference.

BACKGROUND OF THE INVENTION

1. Field of the Invention

This invention relates generally to railway vehicle couplers and more particularly to an improved coupler that is lighter in weight.

2. Brief Description of the Related Art

Railway couplers, particularly those utilized for railway freight cars or vehicle have a coupler body which is an integral casting of a coupler head and a shank. The head of the shank may be an AAR Standard Type "E" or "F" Coupler Head. The head also carries a knuckle and includes a lock, a thrower, a pivot pin and an articulated lock assembly. The coupler is made from a casting formed from low alloy steel. Although there are AAR standards for couplers, the length of the shank from the butt end of the coupler to the location where the shank joins the head may vary. The coupler is designed to be installed on a draft yoke of a railway vehicle. The butt end of the coupler shank is a spherical surface and bears against the face of the front follower of the yoke. The coupler is pivotally mounted on a yoke with a pin that joins the coupler to the vehicle's draft yoke.

Railcar couplers are disposed at each end of a railway car to enable joining one end of such railway car to an adjacently disposed end of another railway car. Couplers generally carry a knuckle which is pivotally mounted on the coupler head and is designed to engage with another knuckle carried on an adjacent coupler or another car. Examples of railway freight car coupler knuckles are taught in U.S. Pat. Nos. 4,024,958; 4,206,849; 4,605,133; and 5,582,307.

Typically, couplers are heavy shafts that extend from each rail car. Generally, each coupler is engaged with a yoke housing a shock-absorbing element referred to as the draft gear. The type-E coupler is the standard coupler for railway freight cars. The type-E coupler has standard specifications such that producers making a type-E coupler adhere to a standard specification, so that the standard railway car couplers are completely interchangeable, regardless of the manufacturer. In addition, adherence to a standard also enables couplers from any one manufacturer to be able to be readily joined to couplers from any other domestic manufacturer. The Association of American Railroads ("AAR") has adopted standards for railway couplers. The coupler must include specific geometry and dimensions that allow it to receive a knuckle, and the geometry must be such that the knuckle is allowed to freely operate when coupling and uncoupling railway cars. These dimensions and features of the coupler may be checked for compliance with AAR standards by using gauges, which are applied to the coupler to verify the coupler dimensions or parameters are within an allowable variation or tolerance range.

Couplers have a particular life, and in instances may fail. In many cases when a railcar coupler fails, a replacement coupler must be carried from the locomotive at least some of the length of the train, which may be up to 25, 50 or even 100 railroad cars in length. The repair of a failed coupler can be labor intensive, can sometimes take place in very inclement weather and can cause train delays.

SUMMARY OF THE INVENTION

According to a preferred embodiment, an improved railway vehicle coupler is provided.

In accordance with a particular embodiment, a railcar coupler includes a coupler head portion extending from a shank portion. The coupler head portion is configured to couple to a first coupler knuckle for coupling the railcar coupler to a second railcar coupler of an adjacent railcar. The coupler head portion comprises a nose portion and a gathering face extending from the nose portion for engaging a second coupler knuckle coupled to the second railcar coupler. The coupler head portion also comprises a guard arm portion extending from the nose portion.

According to preferred embodiments, the coupler has one or more zones of weight reduction. Preferred embodiments may include one or more zones of weight reduction in the shank of the coupler.

According to some preferred embodiments, the coupler has one or more weight reduction zones provided in the front or head of the coupler, which may include a cavity formed in the front face of the coupler, bores provided in the front face of the coupler head, and one or more cavities provided in the guard arm.

According to some preferred embodiments, weight reduction zones are provided in the head portion and shank portion of the coupler.

According to a preferred embodiment, the zones of weight reduction also may be constructed to include strengthening structures such as ribs or walls that are arranged to facilitate the handling of forceloads through the coupler structure.

It is an object of this invention to provide an improved coupler for a railway vehicle.

It is an object of the invention to provide a coupler that is lightweight and suitably strong to handle forces and loads imparted on the coupler when in use installed on a railway vehicle.

It is another object of the invention to provide a method for producing couplers constructed to meet standard specifications as set forth by the Mechanical Committee of Standard Coupler Manufacturers and/or the AAR.

According to one preferred method, the coupler is produced by sand casting with the use of cores to provide the cavities in the casting. Although the coupler may be produced by casting, the coupler also may be produced according to a preferred method disclosed in U.S. patent application Ser. No. 14/273,140, filed on May 8, 2014, for a method for producing a coupler and an improved coupler, the complete contents of which are incorporated by reference.

According to a preferred embodiment, a lightweight coupler is provided which is constructed from a material that is stronger than grade E cast steel. Is a further object to accomplish the above objects by providing a coupler that is constructed from a material that is at least as strong, or even stronger, than grade E cast steel but which is lighter in weight than grade E cast steel.

It is another object of the invention to accomplish the above objects by providing a coupler with an interior and/or exterior geometry that has one or more arrangements, including preferred arrangements, of cavities and ribs, or combinations thereof.

According to some preferred embodiments, it is another object to provide a coupler having a maximum wall thickness of the shank and butt walls, which may include walls defining cavities, which are preferably less than about 1.6" and more preferably less than about 1.15", and where the coupler also is constructed from a material that is lighter and of similar, or greater, strength than grade E cast steel.

It is an object of the invention to provide a coupler that is constructed from an austempered ductile metal. In a preferred embodiment, the austempered metal is austempered ductile iron (ADI). In another preferred embodiment the austempered metal is austempered steel, such as austempered alloy steel, and, according to other embodiments, the coupler may be constructed from an austempered metal alloy.

It is another object of the invention to produce a coupler that may be constructed using less material for the final coupler product, thereby conserving material.

The lightweight couplers according to the invention may be used with standard knuckles or lightweight knuckles, including, such as, for example, the lightweight knuckles disclosed in our co-pending U.S. patent application Ser. No. 14/171,719, filed on Feb. 3, 2014, U.S. patent application Ser. No. 14/171,700, filed on Feb. 3, 2014, U.S. patent application Ser. No. 13/842,229, filed on Mar. 15, 2013 and U.S. patent application Ser. No. 13/678,021, filed Nov. 15, 2012, for a lightweight fatigue resistant knuckle, the complete contents of which are herein incorporated by reference.

Other technical advantages are provided to one skilled in the art from the following figures, descriptions and claims. Moreover, while specific advantages have been enumerated above, various embodiments may include all, some or none of the enumerated advantages.

BRIEF DESCRIPTION OF THE DRAWING FIGURES

Figure 1:
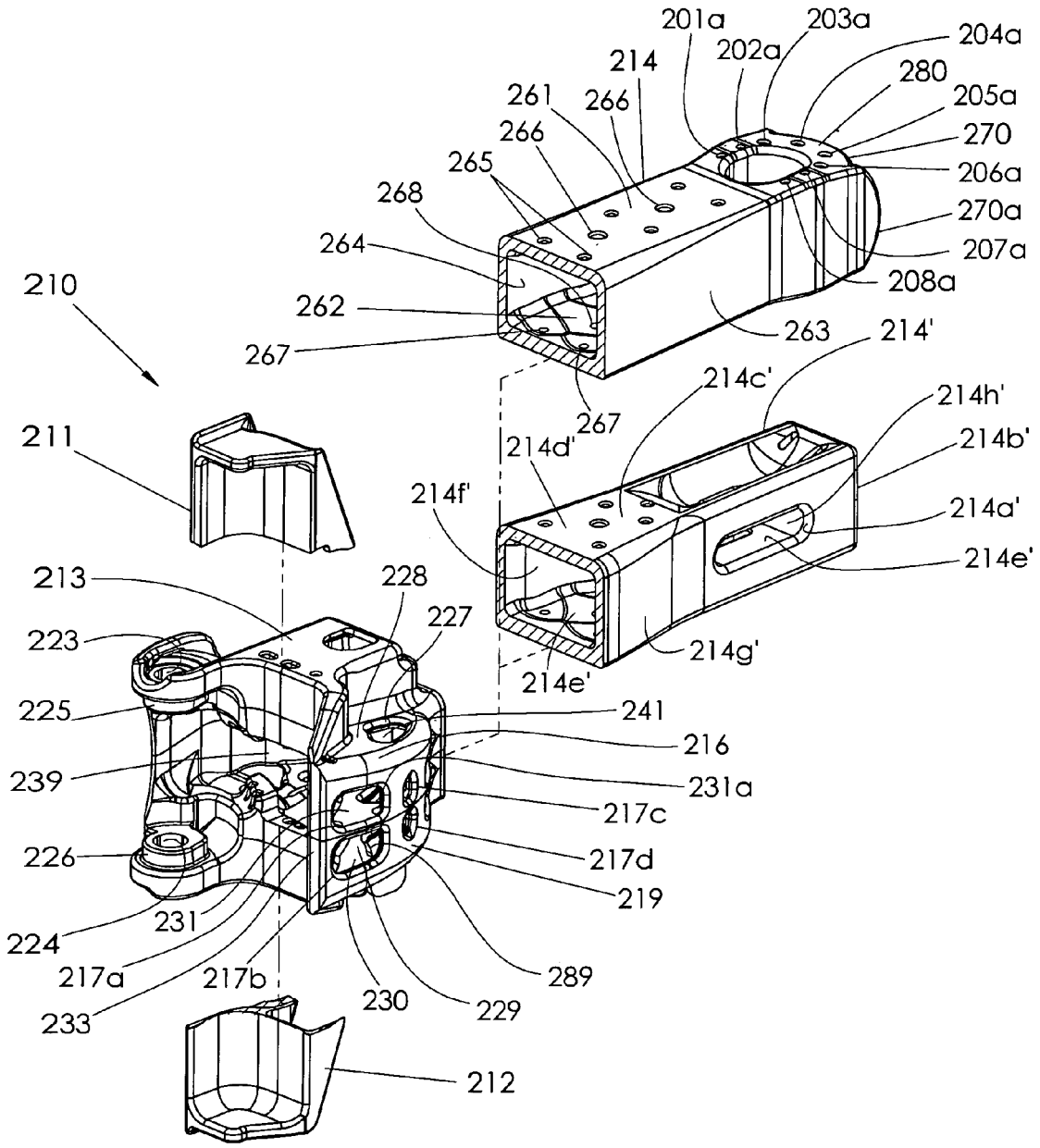
FIG. 1 is a perspective view of a coupler, the coupler being shown in an exploded view with the shank, upper shelf and lower shelf separated and sectioned from the coupler head.
Figure 4:
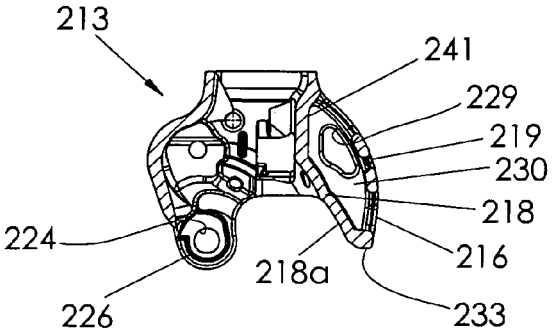
FIG. 4 is a sectional view of the coupler of FIG. 1, showing the head separate and broken away from the other portions, the section being taken along the section line 4-4 of FIG. 8.
Figure 5:
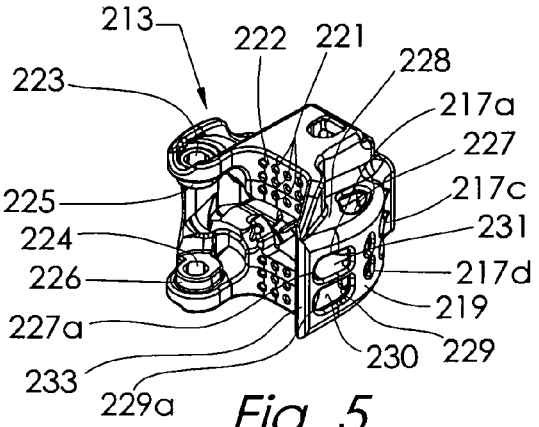
FIG. 5 is a perspective view of the coupler of FIG. 1, showing the head separate and broken away from the other portions, as viewed from the front, looking down from the top of the left side thereof.
Figure 8:
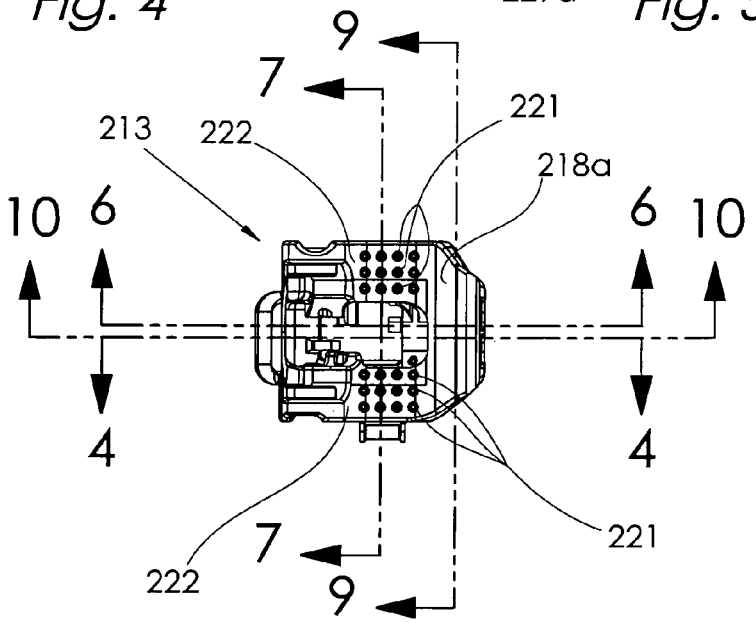
FIG. 8 is a front elevation view of the coupler of FIG. 1.
Figure 9:
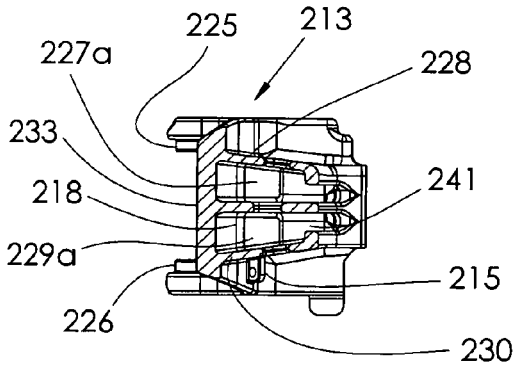

FIG. 9 a sectional view of the coupler of FIG. 1, showing the head separate and broken away from the other portions, the section being taken along the section line 9-9 of FIG. 8.

Figure 10:
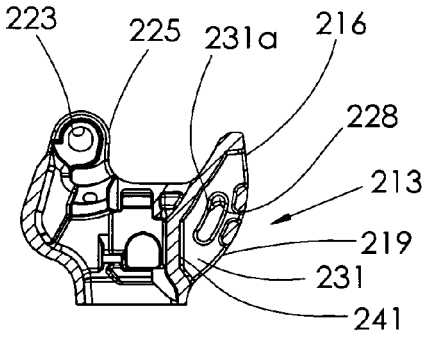

FIG. 10 is a sectional view of the coupler of FIG. 1, showing the head separate and broken away from the other portions, the section being taken along the section line 10-10 of FIG. 8.

Figure 11:
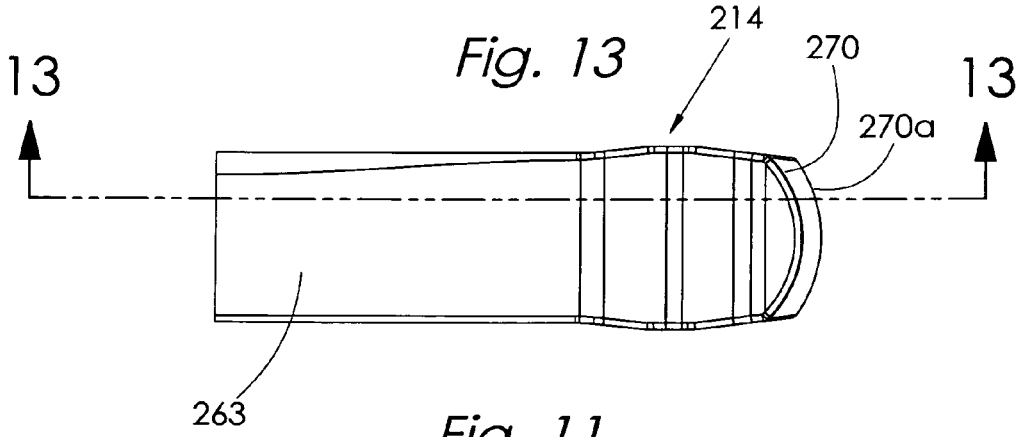

FIG. 11 is a right side elevation view of the rear portion of the coupler shank, shown broken away from the front portion of the shank and the coupler head.

Figure 12:
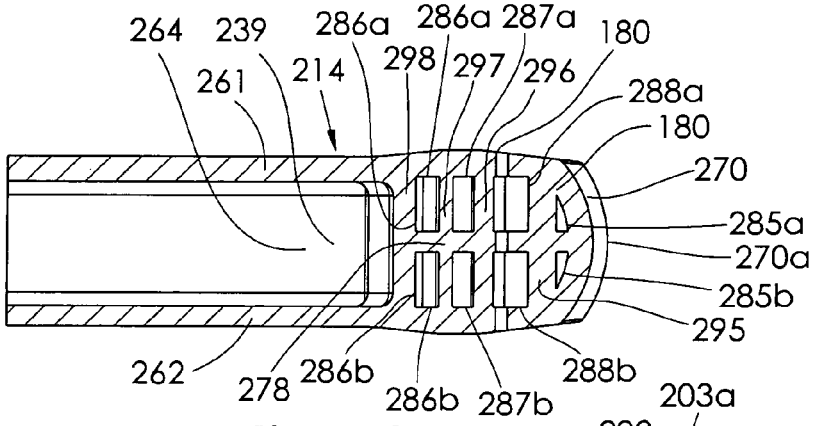
Figure 13:
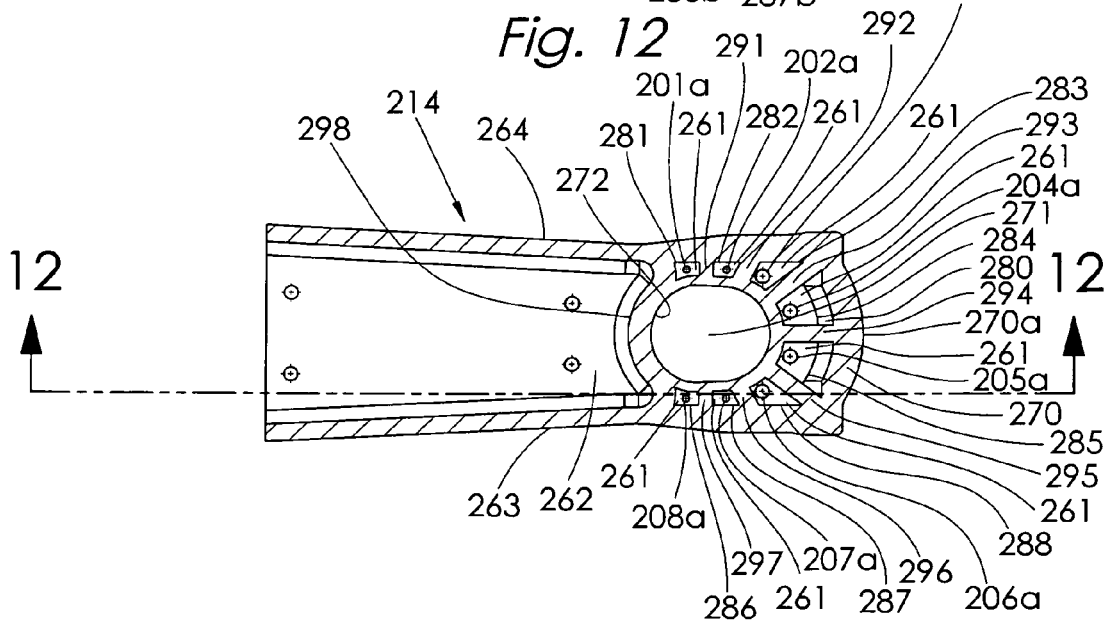

FIG. 12 is a sectional view of the coupler shank portion of FIG. 11, taken along the section line 12-12 of FIG. 13.

FIG. 13 is a sectional view of the coupler shank portion of FIG. 11, taken along the section line 13-13 of FIG. 11, with the section representing the height of the shank as depicted in the side elevation view of FIG. 11.

Figure 14:
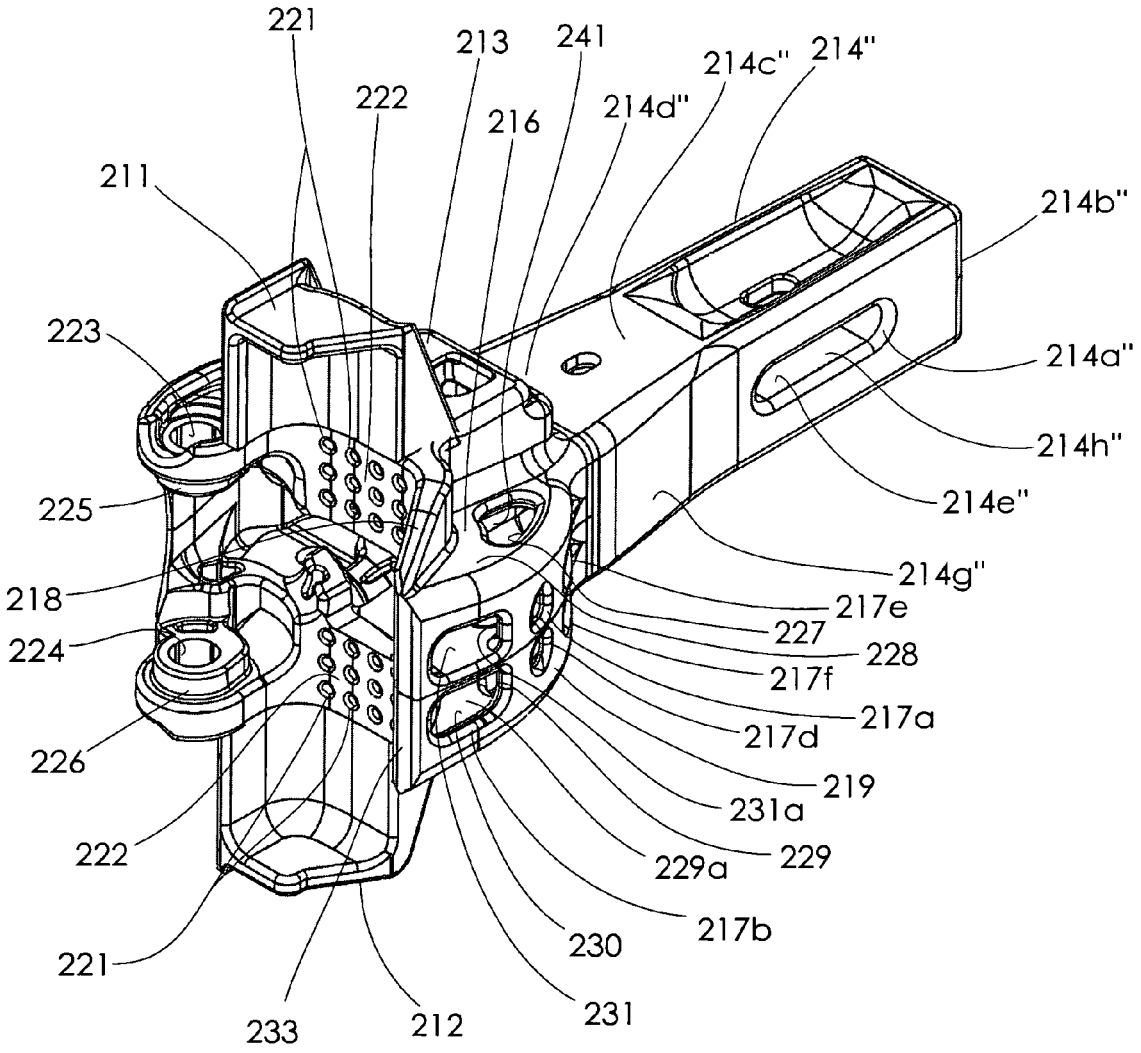

FIG. 14 is a perspective view of the coupler of FIG. 1 shown with an alternate shank and having bores in the coupler front face, and being shown in an assembled condition.

Figure 15:
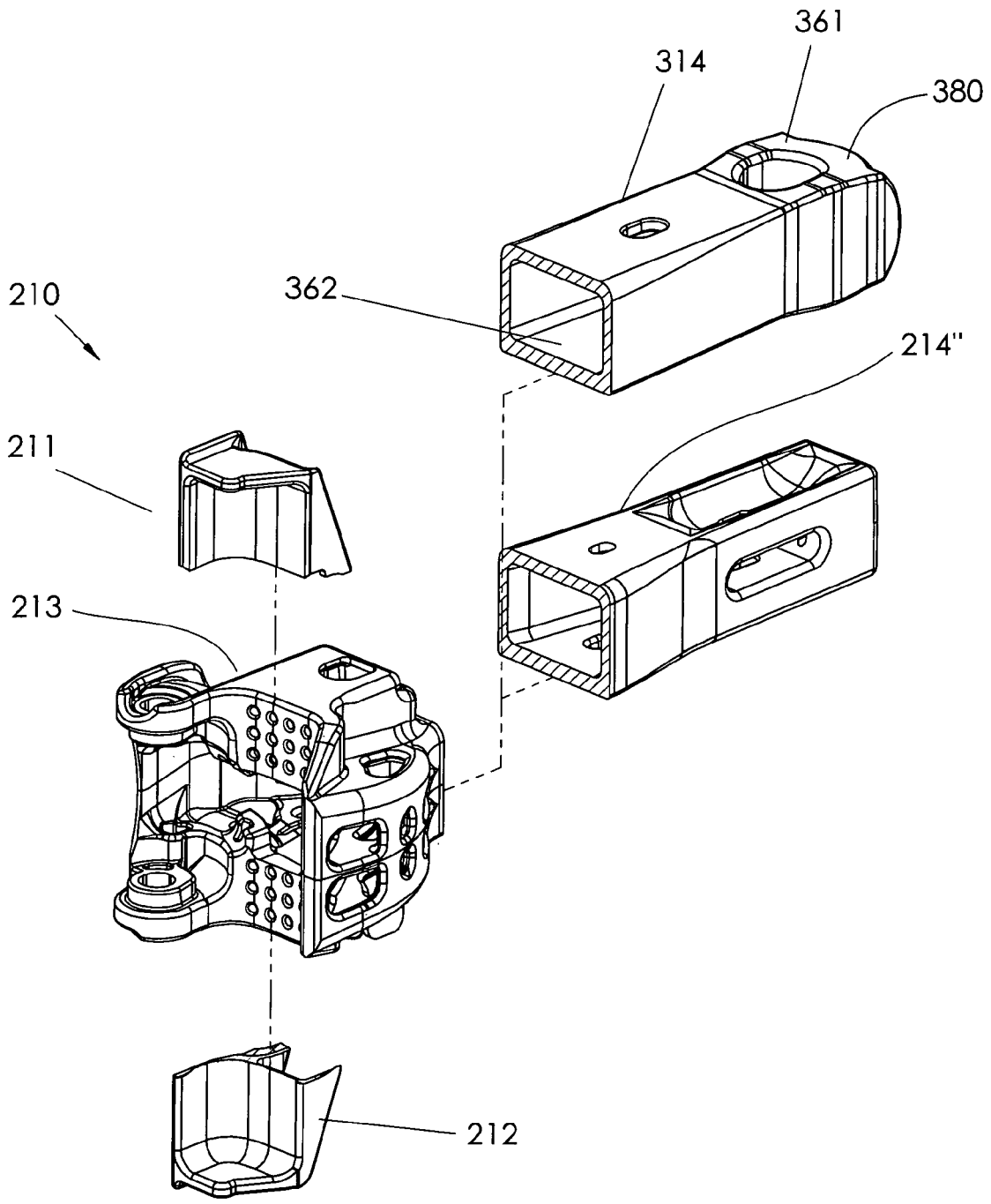

FIG. 15 is a perspective view of the coupler of FIG. 1, shown with an alternate E-type shank and the F-type shank of the assembled coupler shown in FIG. 14, the coupler being shown in an exploded view with the shanks, upper shelf and lower shelf separated and sectioned from the coupler head.

DETAILED DESCRIPTION OF THE INVENTION

Referring to FIGS. 1-15, there is illustrated a preferred embodiment of a railway vehicle coupler 210 for freight railway cars is illustrated in accordance with a preferred embodiment of the invention. The coupler 210 may be produced using any suitable method, including casting. According to some embodiments, couplers according to the invention may be constructed to meet standard specifications as set forth by the Mechanical Committee of Standard Coupler Manufacturers.

Coupler 210 is mounted within a yoke (not shown) secured at each end of a railway car center sill, such that, in accordance with a preferred mounting arrangement, the coupler 210 may extend outwardly under an end of a railway car to engage a similar coupler (or any compatibly connectible coupler) extending outwardly under an end of an adjacent railway car. Coupler 210 includes a shank 214 having a bore 271 which is adapted to connect to the yoke (not shown) on the end of a center sill of a railway vehicle. The generally V-shaped coupler head 213 is provided at a forward end extending from the shank 214. The shank 214 is adapted to be fitted within and attached to a yoke secured at each end of a center sill extending full length under the railway car at a longitudinal axis. The coupler head 213 is provided to receive a vertical-knuckle (not shown) rotatably pinned at an outer end of the coupler head 213 forming a first leg of the coupler head 213, while a second leg of the coupler head 213 comprises a fixed and rigid guard arm portion 216.

Figure 2:
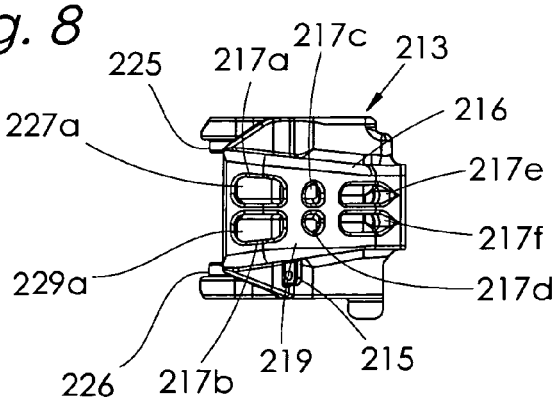
FIG. 2 is a left side elevation view of the coupler of FIG. 1, showing the coupler head separate and broken away from the shank and top and bottom shelves, and being shown with the optional bores provided in the front face of the coupler (which also are shown in FIGS. 3-10, 14 and 15).

The coupler head 213 further includes pivot pin openings, including an upper pivot pin opening 223 and a lower pivot pin opening 224, and pivot lugs, including an upper pivot lug 225 and a lower pivot lug 226. The pivot pin openings 223,224 are provided to receive a knuckle pin (not shown) which is installed in the pivot pin openings 223,224 when a knuckle is seated at the pivot lugs 225,226. The pivot lugs 225,226 and pin, when installed, pivotally retain a knuckle on the coupler head. The coupler head 213 preferably is configured with the pivot lugs 225,226 aligned with the respective pivot openings 223,224. Referring to FIG. 2, the coupler 210 also includes a chain lug 215 provided on the coupler head 213. Although the chain lug 215 is shown located below the guard arm 216, according to some alternate embodiments, chain lugs in some couplers may be located on a coupler lock chamber.

Figure 3:
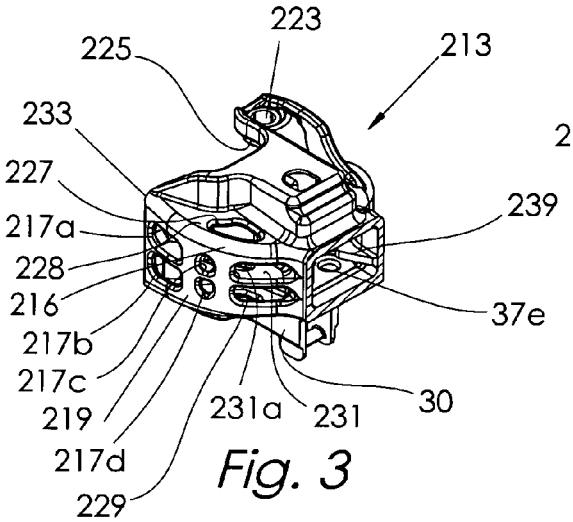
FIG. 3 is a perspective view of the coupler of FIG. 1, showing the head separate from the other portions of the coupler, as viewed from the rear, looking down from the top of the left side thereof.
Figure 6:
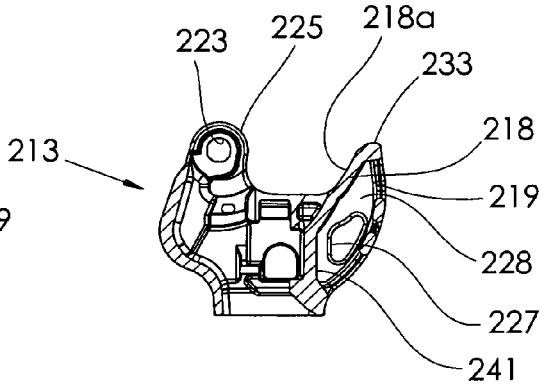
FIG. 6 is a sectional view of the coupler of FIG. 1, showing the head separate and broken away from the other portions, the section being taken along the section line 6-6 of FIG. 8.

The coupler 210 also is shown having a first angled gathering surface 218*a* provided on the gathering wall 218 of the coupler head 213. According to the preferred embodiment illustrated, the coupler 210 has a plurality of cavities. The coupler 210 is shown having a plurality of cavities provided in the guard arm 216. The coupler head 213, provided at the front of the coupler 210, is shown having a guard arm portion 216 with a first plurality of cavities provided in the guard arm, which include an upper cavity 227*a* and a lower cavity 229*a*. A plurality of openings preferably are provided in the head 213. Referring to FIGS. 1 and 3, an upper opening 227 is provided in the top surface or upper wall 228 of the guard arm 216. According to a preferred embodiment, a lower opening 229 is provided in the guard arm lower surface or bottom wall 230. The openings 227,229 may be defined by one or more interior sidewalls, such as for example, the inner cavity side wall 241 and gathering face wall 218, as well as by the upper wall 228 and lower wall 230. The openings 217*a*,217*b*,217*c*,217*d*, 217*e*,217*f* in the guard arm side wall 219 preferably are bordered by a portion of the side wall 219. Referring to FIG. 9, according to a preferred embodiment, the coupler 210 is constructed having a plurality of cavities in the head 213, and preferably a plurality of the cavities are formed in the guard arm 216, including an upper guard arm cavity 227*a* and a lower guard am cavity 229*a*. The upper and lower guard arm cavities 227*a* and 229*a*, respectively, preferably form the guard arm interior space. According to a preferred embodiment, the coupler 210 is constructed with a mid wall portion 231 spanning between the gathering face wall 218 and the guard arm side wall 219. The mid wall portion 231 preferably, along with the upper wall 228, defines the upper cavity 227*a* and with the lower wall 230 defines the lower cavity 229*a*. The mid wall portion 231, as shown in FIG. 10, preferably includes an opening 231*a* therein providing communication between the upper cavity 227*a* and lower cavity 229*a*.

According to a preferred embodiment illustrated, the guard arm portion 216 of the coupler 213 extends from the coupler nose portion 233 to the rear of the coupler head 213 where the coupler head joins with the shank 214. The coupler head 213 joins with a shank 214. The coupler includes a front face 222 and has a cavity 239 that extends through the coupler head 213 and through the shank 214.

According to some embodiments, the construction is provided so that the slope and configuration of the guard arm portion 216 provide strength and stability to the coupler 210, and in particular the portion of the coupler 210 extending between the nose portion 233 and the shank 212.

In accordance with a preferred embodiment, the coupler 210 has a shank 214,214' (shown in FIG. 1) and, alternatively, may have a shank 214" (shown in FIGS. 14 and 15) or shank 314 (shown in FIG. 15). A first embodiment of the coupler 210 includes a shank having a configuration of the first shank 214 (FIGS. 1, 11-13), and according to an alternate embodiment, the coupler 210 may be produced having an alternate shank 214' (FIG. 1), or alternate shank 214" (FIGS. 14 and 15) or an alternate shank 314 (FIG. 15). The shank 214 has a top wall 261, a bottom wall 262, a first side wall 263 and a second side wall 264. The top wall 261 is shown having openings 265,266 therein. The bottom wall 262 has openings 267,268 therein. The shank 214 joins with the head 213 of the coupler 210.

Referring to FIGS. 12-13, the coupler shank 214 is depicted to illustrate a preferred configuration for the interior rear or butt portion of the shank 214. According to a preferred embodiment, the shank 214 has a rear wall 270 with a spherical face 270*a* which is provided to preferably engage with a complementary spherical face of a follower member (not shown). The coupler shank 214 has a bore 271 therein which is adapted to connect to a yoke (not shown) on the end of a center sill of a railway vehicle. The bore 271 preferably is defined by a wall 272. A connecting wall 298 (FIG. 12) forms part of the bore wall 272 and connects the first side wall 263 with the second side wall 264. According to preferred embodiments, the wall 272 may span from the top of the bore 271 on the shank top wall 261 to the bottom of the bore 271 on the shank bottom wall 262, and preferably, the bore 271 extends entirely through the coupler shank 214.

The shank 214 preferably is constructed having a rear weight reduction zone 280 provided at the rear of the coupler shank section 214. The weight reduction zone 280 preferably includes a plurality of cavities and ribs spacing apart the cavities. The cavities preferably may extend between the top and bottom of the shank, and, according to some embodiments, are formed between the top wall 261 and bottom wall 262. According to a preferred embodiment, the cavities provided in the shank 214 preferably are divided into an upper portion and a lower portion. According to a preferred arrangement, a mid wall portion 278 is provided between the shank rear wall 270 and the connecting wall 298 (FIG. 12). The shank mid wall portion 278 preferably divides the cavities 281,282,283,284,285,286,287,288 into a first or upper cavity portion, and a second or lower cavity portion. As illustrated in FIG. 12, the upper and lower cavity portions are shown for the respective cavities 285,286,287,288, with the upper cavity portions, respectively, 285*a*,286*a*,287*a*, 288*a*, being provided above the wall 278 and the lower cavity portions 285*b*,286*b*,287*b*,288*b*, respectively, being provided below the wall 278. The cavities 281,282,283,284 also preferably may have upper cavity portions and lower cavity portions similar to those shown in connection with the cavities 285,286,287,288. According to a preferred embodiment, the weight reduction zone 280 is illustrated with a plurality of cavities 281,282,283,284,285,286,287,288 disposed surrounding the bore wall 272. Referring to FIGS. 12 and 13, according to a preferred embodiment depicted, the cavities 281,282,283,284,285,286,287,288 are defined by a plurality of ribs 291,292,293,294,295,296,297 which span from the bore wall 272 outwardly toward the first side wall 263, rear wall 270 and second side wall 264, respectively. According to a preferred embodiment, each rib 291,292, 293,294,295,296,297 preferably includes a first or upper portion, provided above the mid wall 278, and a second or lower portion, provided below the mid wall 278. Preferably, the ribs or rib portions have a first end joining with one of the top wall 261 or the lower wall 262 and have a second end joining with the mid wall 278. According to one embodiment, the weight reduction zone 280 may include a plurality of openings (not shown) formed in the mid wall 278 of the shank 214. As shown in FIG. 1, preferably, there are openings or bores 201*a*,202*a*,203*a*,204*a*,205*a*,206*a*,207*a*, 208*a* provided in the upper wall 261. Preferably, a plurality of openings (not shown) also may be formed in the lower wall 262, which may be aligned with the openings 201*a*, 202*a*,203*a*,204*a*,205*a*,206*a*,207*a*,208*a* in the top wall 261, the openings in the mid wall 278, or both. The coupler 210 preferably is constructed to include the openings and cavities shown in FIGS. 1 and 12-13 to provide a zone of weight reduction 280 in the butt end of the shank 214. The shank 214 also may include a cavity 239 extending and communicating with the first portion of the cavity 239 in the coupler head 213. The portion of the cavity 239 in the shank 214 preferably extends through the shank 214 and to the bordering or connecting wall 298 (FIG. 12).

The improved coupler 210, according to a preferred embodiment, has an improved configuration for facilitating improved force handling. According to preferred embodiments, couplers according to the invention may be produced having a configuration for linearly managing load. The coupler 210 preferably manages the force transmissions in a linear or substantially linear direction through the length of the coupler.

According to a preferred embodiment, the mid wall 278 preferably may be provided at a height corresponding with the height of the mid wall 231 of the guard arm portion 216 of the coupler head 213. According to a preferred embodiment, the shank mid wall 278 and guard arm mid wall 231 may be disposed at substantially the same height so as to be located along a transverse plane taken through the coupler 210.

The coupler 210 includes a force handling structure, which preferably has one or more transverse layers, such as the wall or layer 231 that spans across the guard arm interior and separates the guard arm interior into cavities 227*a*,229*a*. The coupler 210 has a plurality of interior cavities, including the guard arm cavities 227*a*,229*a*, which are formed by the top and bottom walls 228,230 and mid wall 231. According to some embodiments, a plurality of bores 221 also are provided in the front face 222 of the head 213 (see FIGS. 2-10, 14 and 15). According to some alternate embodiments, the coupler front face 222 may be provided without the bores 221 (see FIG. 1). In addition to providing weight reduction, the coupler 210 preferably is constructed to provide improved force handling. One preferred configuration includes the plurality of ribs and cavities provided in the butt end of the shank 214, as shown adjacently spaced about the bore 271, and may include the mid wall 278, as well as other walls, including the transversely disposed guard arm wall 231. According to a preferred construction, the transverse rib or layer 231 provided in the guard arm 216 is provided along a path parallel to the anticipated force direction that the coupler 210 handles when a pulling force is applied to the coupler 210. The coupler 210 preferably is constructed to be suitably strong to handle forceloads as well as being lighter in weight.

Referring to FIG. 1, an alternate embodiment of a shank 214' is shown, which forms an alternate coupler having the preferred head 213, upper shelf 211 and lower shelf 212. Similar to the shank 214 shown and described herein, the alternate shank 214' is designed to be fitted within and attached to a yoke (not shown). In the configuration illustrated, the shank 214' has a key slot 214*a*' extending laterally through the shank 214' adjacent the butt 214*b*'. A key (not shown) may extend through the slot 214*a*' to secure the coupler 210 to a yoke (not shown). The shank 214' preferably is configured having a dimension for the key slot 214*a*' that is in accordance with the AAR standards. The exterior dimensions of the shank 214', preferably also may have AAR standard dimensions. According to a preferred embodiment, the shank 214' joins with the front of the coupler or head 213. The shank 214' preferably is configured having a box-like front or forward section 214*c*' defined by top and bottom walls 214*d*',214*e*', and opposed side walls 214*f*',214*g*'. The shank 214' top and bottom walls 214*d*',214*e*' may be inwardly angled. According to some embodiments the walls 214*d*',214*e*' may increase in cross-section proximate the key slot 214*a*'. According to a preferred embodiment, the shank 214' is constructed having a cavity 214*h*' formed therein, which may extend from the opening where the shank 214' joins with the head 213, and the cavity 214*h*' preferably extends through the shank 214' to the end of the shank 214*i*' opposite the head 213. The shank cavity 214*h*' preferably may be a continuation of the cavity 239 through the head 213.

FIG. 14 illustrates the coupler 210 of FIG. 1, shown assembled and with a coupler head 213, an alternate shank 214", an upper shelf 211 and a lower shelf 212. In regard to the shank 214", reference numerals appearing on FIG. 14 correspond with the reference numerals of the shank 214' shown in FIG. 1, expect that in FIG. 14, the reference numerals are indicated as double prime "instead of single prime. In addition, the coupler 210, as shown in FIG. 14, has a plurality of bores 221 provided in the front face 222 of the coupler head 213. According to some preferred embodiments, the alternate shank 214" as well as the shank 214' may be constructed having a weight reduction zone as discussed herein in connection with the shanks 214,314, where the weight reduction zone preferably is provided at the butt portion of the shank and may include ribs or wall sections and cavities.

Referring to FIG. 15, the coupler 210 is shown configured similar to the coupler 210 shown in FIG. 1, but illustrating the shank 214" of FIG. 14 and an alternate shank 314. According to some alternate embodiments, the coupler 210 may be constructed with the F-type shank 314 as an alternate embodiment, with the coupler head 213, and optionally may include one or more of the upper and lower shelves 211, 212. The alternate shank 314 preferably includes a weight reduction zone 380 provided at the rear of the coupler shank 314. The alternate shank 314 preferably may be constructed similar to the shank 214, but without the plurality of bores in the top surface and bottom surface. Although the shank 314 does not show bores extending through the surfaces, the shank 314 may be constructed having cavities, ribs and walls in the rear portion thereof, which may be similar to those shown in FIGS. 11-13 provided in the shank 214, but without the surface bores. For example, the weight reduction zone 380 of the alternate shank 314 preferably may include a plurality of cavities and ribs spacing apart the cavities. As an example, cavities in the shank 314 preferably may extend between the top and bottom of the shank 314, and, according to some embodiments, may be formed between the top wall 361 and bottom wall 362.

The coupler 210 preferably has shelves, including an upper shelf 211 and a lower shelf 212 that are provided on the head 213. Although the coupler is illustrated showing a preferred embodiment of a coupler 210 with a coupler head 213 and alternate shank options 214,214',214",314, alternate configurations for the upper shelf 211 and lower shelf 212 also may be provided.

The coupler 210 including using the configuration of the shank 214 and the preferred weight reduction zone 280 provided therein, preferably is lighter in weight, yet suitably strong to meet or exceed the AAR standards for railcar couplers. According to some embodiments, the coupler 210 may be constructed so that the walls have preferred thicknesses that will produce a coupler according to acceptable AAR standards. According to some preferred embodiments, the shank 214,214',214",314 may be constructed having maximum wall thicknesses of preferably less than about 1.6" and, more preferably, if ADI is used to produce the coupler, less than about 1.15" and preferably less than about 1.0" and, more preferably less than about 0.65" if austempered steel is used.

Figure 7:
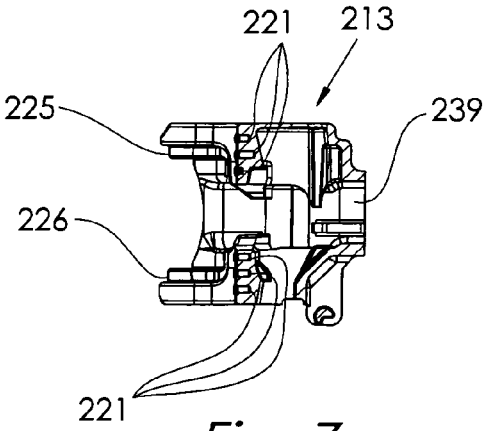
FIG. 7 is a sectional view of the coupler of FIG. 1, showing the head separate and broken away from the other portions, the section being taken along the section line 7-7 of FIG. 8.

According to some embodiments, a further weight reduction zone is provided in the front of the coupler or in the coupler head 213, and includes a plurality of bores 221 formed in the front face 222 of the coupler head 213. Although the bores 221 are referenced in FIG. 8 with a single numeral, the bores 221 may be provided having different depths, as shown in FIG. 7, where the bores 221 are provided in the face and face wall 222.

According to one preferred embodiment, the coupler 210 preferably is formed by treating it with a treatment process, and preferably a process to strengthen the material, and to provide a suitable microstructure in the formed coupler which has improved resistance to fatigue and cracking, and which may be lighter as well. Preferably, the treatment process involves an austenitizing process, by which the formed coupler is an austempered material. For example, the forming of the coupler may involve applying a suitable austenitizing process. One preferred method involves heating the metal coupler, such as, for example a ductile iron coupler to an austenitizing temperature, and then quenching, such as in a salt bath or other heat extraction composition. The austenitizing process may be applied to the molded coupler (where the coupler is formed using by molding) or coupler casting (where the coupler is formed by casting), or a coupler produced using another process to form it. Alternatively, the coupler may be formed from steel or other suitable metal, including, for example, grade E steel traditionally used to form couplers.

Some other preferred examples of materials that may be used in accordance with the invention to form the coupler include austempered metal, such as, for example, austempered ductile iron, austempered steel and austempered alloy steel, as well as alloys of these materials. Austempered ductile iron may include ductile iron alloyed with one or more metals, such as, for example, nickel, molybdenum, manganese, copper and mixtures thereof.

According to some embodiments, couplers produced with the method of the present invention may be constructed having heights, lengths and widths similar to those of standard couplers, such as Type E and Type F couplers. According to some preferred embodiments, couplers may be constructed in accordance with the invention having preferred dimensions. The coupler has improved surface finishes to contribute to providing higher fatigue strength for the coupler. For example, the coupler may have a surface finish of about 125-175 RMS. According to some preferred embodiments, couplers may have wall thicknesses preferably less than about 1.6" and, more preferably, if ADI is used to produce a coupler, less than about 1.15" and preferably less than about 1.0" and, more preferably less than about 0.65" if austempered steel is used. In addition, according to some preferred embodiments, the couplers may be produced having some or all of the advantages discussed herein and meet the AAR specification, M-216.

These and other advantages may be realized with the present invention. While the invention has been described with reference to specific embodiments, the description is illustrative and is not to be construed as limiting the scope of the invention.

According to preferred embodiments of the invention, lightweight couplers may be constructed from grade E steel, such as for example, couplers configured with one or more weight reduction zones provided in the coupler head and/or coupler shank to reduce the weight of the coupler. According to other preferred embodiments, lightweight couplers, including the coupler 210, and, including, in addition thereto, couplers configured with a construction of one or more weight reduction zones may be constructed from an austempered metal, preferably austempered steel, austempered ductile iron, austempered steel alloy or austempered ductile iron alloy. Preferred compositions, such as steel, as well as alloy steel compositions, e.g., alloyed preferably with magnesium, manganese, molybdenum, copper or mixtures thereof, or more preferably, with chromium, nickel or mixtures thereof, (or mixtures of the preferred and more preferred metals), may be used to form the couplers as discussed and shown herein. The steel or preferred/more preferred alloy steel composition is austempered to obtain tensile strength, yield, and elongation properties for the inventive couplers which are suitable to meet or exceed the AAR standards for couplers, including the current standard set forth by the American Association of Railroads (AAR) in AAR Manual of Standards and Recommended Practices, such as current standard M-211, M-205, M-220 NDT and Rule 88 of the AAR Office Manual, the complete contents of which are herein incorporated by reference. Couplers may be constructed from ductile iron that is austempered. The ductile iron also may be used in alloy form, preferably, with nickel, molybdenum, manganese, copper, or mixtures thereof, to form couplers.

Lightweight couplers may be produced using the improved coupler configurations disclosed and shown herein. In addition, lightweight couplers are constructed from austempered ductile iron, austempered ductile iron alloy, austempered steel, and/or austempered steel alloy, in accordance with the invention, to provide couplers that are lighter in weight than prior couplers yet possesses suitable strength, yield and fatigue resistant properties that meet or exceed AAR testing and standards requirements set forth by the American Association of Railroads (AAR) in AAR Manual of Standards and Recommended Practices, and in Rules of the AAR Office Manual, the compete contents of which are herein incorporated by reference.

It is intended that the foregoing detailed description be regarded as illustrative rather than limiting, and that it be understood that it is the following claims, including all equivalents, that are intended to define the spirit and scope of this invention. Various modifications and changes may occur to those skilled in the art without departing from the spirit and scope of the invention described herein and as defined by the appended claims. Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A railway vehicle coupler constructed having at least one zone of weight reduction therein provided in one or more of the guard arm, head front face and shank;

the coupler having a head and a shank, the head including a guard arm, wherein said head has a gathering wall and a gathering face on said gathering wall, wherein said guard arm has a guard arm side wall, a guard arm top wall, a guard arm lower wall, wherein a first cavity is provided in said guard arm, wherein a second cavity is provided in said guard arm, and wherein a mid wall spans between said gathering wall and said guard arm side wall and is located between said guard arm top wall and said guard arm lower wall.

2. The railway vehicle coupler of claim 1, the head further including a front face, wherein a plurality of bores are provided in the front face of the head.

3. The railway vehicle coupler of claim 1, wherein a top opening is provided in said guard arm top wall, wherein a bottom opening is provided in said guard arm bottom wall, and wherein a mid opening is provided in said mid wall, wherein said first cavity communicates with said second cavity through said mid wall opening.

4. The railway vehicle coupler of claim 1, wherein said shank has a bore therethrough, and wherein said shank comprises a plurality of cavities and ribs adjacently arranged around the shank bore.

5. The railway vehicle coupler of claim 4, wherein said shank has a top wall and a bottom wall, wherein said shank cavities are disposed between said top wall and said bottom wall, wherein said cavities have an upper cavity portion and a lower cavity portion, and wherein a mid wall is disposed between said upper cavity portion and said lower cavity portion.

6. The railway vehicle coupler of claim 5 wherein said cavities comprise a plurality of upper cavity portions and a plurality of lower cavity portions, wherein a first plurality of bores is provided in the top wall above said plurality of upper cavity portions, wherein each bore communicates with one of the said plurality of upper cavity portions, and wherein a second plurality of bores is provided in the bottom wall below said plurality of lower cavity portions, wherein each bore of the second plurality of bores communicates with one of the said plurality of lower cavity portions, and wherein a third plurality of bores is provided in the mid wall, wherein each bore of the third plurality of bores communicates with one of the said plurality of upper cavity portions and with one of the said plurality of lower cavity portions.

7. The railway vehicle coupler knuckle of claim 5, the head including a guard arm, wherein said head has a gathering wall and a gathering face on said gathering wall, wherein said guard arm has a guard arm side wall, a guard arm top wall and a guard arm lower wall, wherein a first cavity is provided in said guard arm, wherein a second cavity is provided in said guard arm, wherein said guard arm has a mid wall spanning between said gathering wall and said guard arm side wall and being located between said guard arm top wall and said guard arm lower wall; and wherein said shank mid wall and said guard arm mid wall are disposed at substantially the same height so as to be located along a transverse plane taken through the coupler.

8. The coupler of claim 1, wherein said coupler is made of austempered metal.

9. The railway vehicle coupler of claim 8, wherein the austempered metal is selected from the group consisting of austempered ductile iron and austempered steel.

10. The railway vehicle coupler of claim 9, wherein said austempered ductile iron comprises ductile iron alloyed with one or more metals selected from the group consisting of nickel, molybdenum, manganese, copper and mixtures thereof, wherein said ductile iron alloyed with said one or more said metals is austempered to produce said vehicle coupler.

11. The railway vehicle coupler of claim 10, wherein said austempered steel comprises steel alloyed with one or more metals selected from the group consisting of chromium, nickel, magnesium, manganese, copper, molybdenum, and mixtures thereof, wherein said steel alloyed with said one or more metals is austempered to produce said vehicle coupler.

12. The railway vehicle coupler of claim 11, wherein said wall thicknesses of said shank walls are preferably between about 0.65 inches and 1.6 inches.

13. A railway vehicle coupler;

wherein said shank has a bore therethrough and a plurality of cavities and ribs adjacently arranged around the shank bore;

wherein said shank has a top wall and a bottom wall, wherein said shank cavities are disposed between said top wall and said bottom wall, wherein said cavities have an upper cavity portion and a lower cavity portion, and wherein a mid wall is disposed between said upper cavity portion and said lower cavity portion;

wherein said cavities comprise a plurality of upper cavity portions and a plurality of lower cavity portions, wherein a first plurality of bores is provided in the top wall above said plurality of upper cavity portions, wherein each bore communicates with one of the said plurality of upper cavity portions, wherein a second plurality of bores is provided in the bottom wall below said plurality of lower cavity portions, wherein each bore of the second plurality of bores communicates with one of the said plurality of lower cavity portions, and wherein a third plurality of bores is provided in the mid wall, wherein each bore of the third plurality of bores communicates with one of the said plurality of upper cavity portions and with one of the said plurality of lower cavity portions; and wherein the thicknesses of said shank top wall, said shank bottom wall, said shank mid wall and said shank ribs are preferably between about 0.65 inches and 1.6 inches.

14. A railway vehicle coupler, comprising:

(a) a shank portion;

(b) a coupler head portion extending from said shank portion, (c) the coupler head portion configured to couple to a first coupler knuckle for coupling the railcar coupler to a second railcar coupler of an adjacent railcar;

(d) the coupler head portion comprising a nose portion and a gathering face extending from the nose portion for engaging a second coupler knuckle coupled to the second railcar coupler;

(e) the coupler head portion comprising a guard arm portion extending from the nose portion towards the shank portion;

(f) a transverse cavity in the coupler head and a transverse cavity in the coupler shank, wherein said coupler head transverse cavity and said shank transverse cavity extend through the coupler and communicate with each other;

(g) the head portion further including a front face with a plurality of bores provided in the front face thereof;

(h) said guard arm portion having a top wall, a lower wall, a side wall, a first guard arm cavity provided in said guard arm, a second guard arm cavity provided in said guard arm, a mid wall spanning between said gathering face and said guard arm side wall and being disposed between said guard arm top wall and said guard arm lower wall;

(i) wherein a top opening is provided in said guard arm top wall, wherein a bottom opening is provided in said guard arm bottom wall, and wherein a mid opening is provided in said guard arm mid wall, wherein said first guard arm cavity communicates with said second guard arm cavity through said mid wall opening;

(j) wherein said shank portion has a bore therethrough, and wherein said shank has a plurality of longitudinal cavities and ribs adjacently arranged around the shank bore;

(k) wherein said shank has a top wall and a bottom wall, wherein said shank longitudinal cavities are disposed between said top wall and said bottom wall, wherein said longitudinal cavities have an upper longitudinal cavity portion and a lower longitudinal cavity portion, and wherein a mid wall is disposed between said upper longitudinal cavity portion and said lower longitudinal cavity portion;

(l) wherein said longitudinal cavities comprise a plurality of upper longitudinal cavity portions and a plurality of lower longitudinal cavity portions, wherein a first plurality of bores is provided in the top wall above said plurality of upper longitudinal cavity portions, wherein each bore communicates with one of the said plurality of upper longitudinal cavity portions; and (m) wherein a second plurality of bores is provided in the bottom wall below said plurality of lower longitudinal cavity portions, wherein each bore of the second plurality of bores communicates with one of the said plurality of lower longitudinal cavity portions, and wherein a third plurality of bores is provided in the mid wall, wherein each bore of the third plurality of bores communicates with one of the said plurality of upper longitudinal cavity portions and with one of the said plurality of lower longitudinal cavity portions.

15. A railway vehicle coupler comprising;

a shank;

wherein said shank has a bore therethrough, and wherein said shank comprises a plurality of cavities and ribs adjacently arranged around the shank bore;

wherein said shank has a top wall and a bottom wall, wherein said shank cavities are disposed between said top wall and said bottom wall, wherein said cavities have an upper cavity portion and a lower cavity portion, and wherein a mid wall is disposed between said upper cavity portion and said lower cavity portion;

wherein said cavities comprise a plurality of upper cavity portions and a plurality of lower cavity portions, wherein a first plurality of bores is provided in the top wall above said plurality of upper cavity portions, wherein each bore communicates with one of the said plurality of upper cavity portions, and wherein a second plurality of bores is provided in the bottom wall below said plurality of lower cavity portions, wherein each bore of the second plurality of bores communicates with one of the said plurality of lower cavity portions, and wherein a third plurality of bores is provided in the mid wall, wherein each bore of the third plurality of bores communicates with one of the said plurality of upper cavity portions and with one of the said plurality of lower cavity portions.

16. The railway vehicle coupler of claim 15, the coupler having a head, the head further including a front face, wherein a plurality of bores are provided in the front face of the head.

17. A railway vehicle coupler comprising:

a shank;

wherein said shank has a bore therethrough, and wherein said shank comprises a plurality of cavities and ribs adjacently arranged around the shank bore;

wherein said shank has a top wall and a bottom wall, wherein said shank cavities are disposed between said top wall and said bottom wall, wherein said cavities have an upper cavity portion and a lower cavity portion, and wherein a mid wall is disposed between said upper cavity portion and said lower cavity portion;

the head including a guard arm, wherein said head has a gathering wall and a gathering face on said gathering wall, wherein said guard arm has a guard arm side wall, a guard arm top wall and a guard arm lower wall, wherein a first cavity is provided in said guard arm, wherein a second cavity is provided in said guard arm, wherein said guard arm mid wall spans between said gathering wall and said guard arm side wall and is located between said guard arm top wall and said guard arm lower wall; and wherein said shank mid wall and said guard arm mid wall are disposed at substantially the same height so as to be located along a transverse plane taken through the coupler.

* * * * *